United States Patent [19]

Moore

[11] Patent Number: 4,982,572

[45] Date of Patent: Jan. 8, 1991

[54] VAPOR INJECTION SYSTEM FOR REFRIGERATION UNITS

[75] Inventor: Robert A. Moore, Hamilton, Canada

[73] Assignee: 810296 Ontario Inc., Hamilton, Canada

[21] Appl. No.: 346,498

[22] Filed: May 2, 1989

[51] Int. Cl.[5] ..... F25B 41/00

[52] U.S. Cl. ..... 62/122; 62/304; 62/500

[58] Field of Search ..... 62/304, 500, 513, 196.4, 62/114, 502, 113, 117, 115, 121, 122

[56] References Cited

U.S. PATENT DOCUMENTS 4,490,993 1/1985 Larriva ..... 62/304

FOREIGN PATENT DOCUMENTS 783777 6/1935 France ..... 62/500

*Primary Examiner*—Henry A. Bennet

*Attorney, Agent, or Firm*—Patrick J. Hofbauer

[57] ABSTRACT

The present invention relates to a method for combining at least two discrete flows of a refrigerant in respective substantially dissimilar thermodynamic states in a vapor compression cycle refrigeration system, including the step of imparting substantial turbulent mixing of the at least two flows to produce a generally thermodynamically uniform admixture thereof. The present invention also relates to an improved vapor compression cycle refrigeration apparatus including means for turbulent mixing of at least two discrete flows of a refrigerant in respective, substantially dissimilar thermodynamic states, which means is operable to produce a generally thermodynamically uniform admixture thereof. The means may be retrofitted to existing equipment and the present invention extends to kits useful to this end and to refrigeration sub-assemblies including such means.

28 Claims, 2 Drawing Sheets

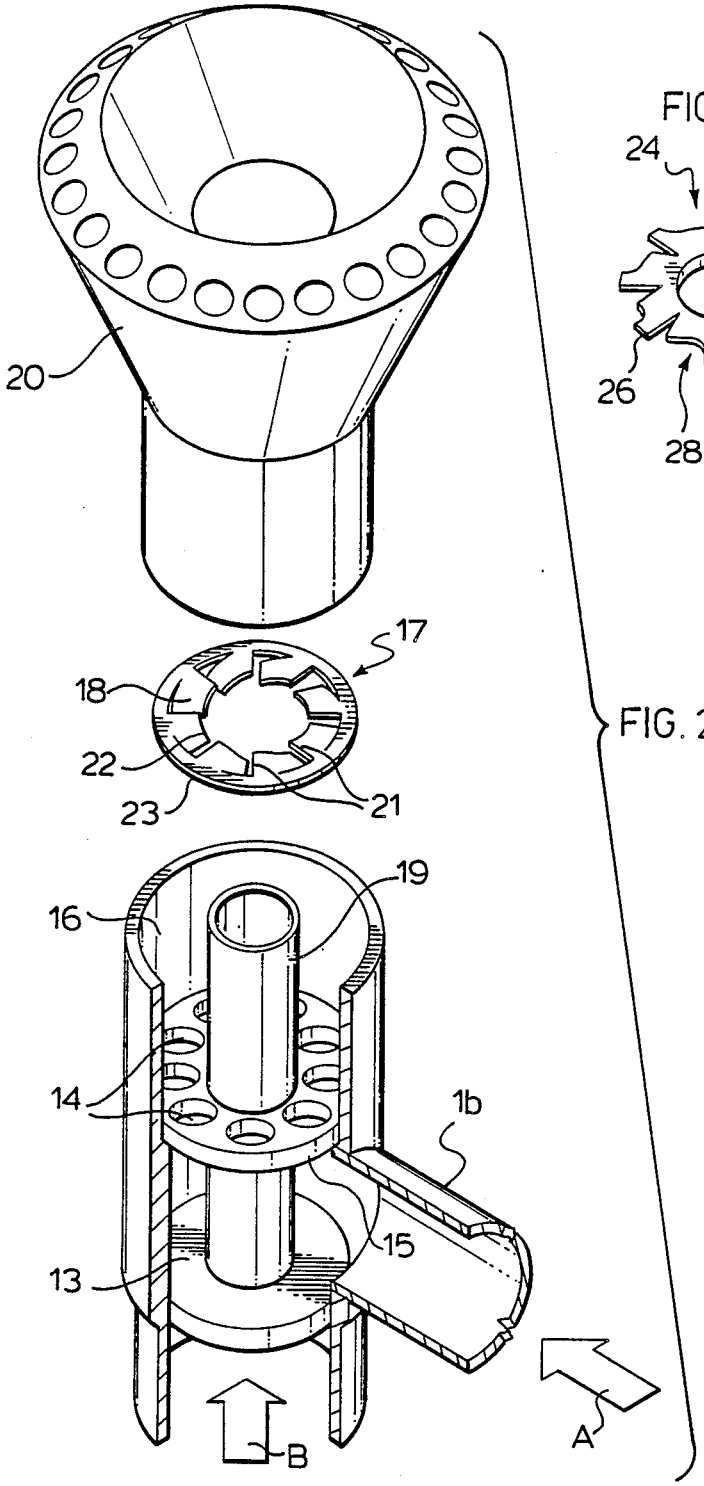
FIG. 2.
FIG. 3.
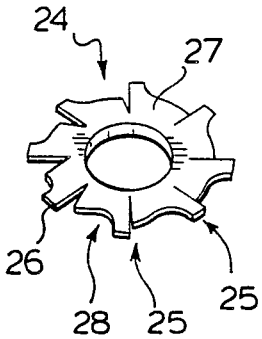

VAPOR INJECTION SYSTEM FOR REFRIGERATION UNITS

FIELD OF THE INVENTION

The present invention relates to improvements in vapour compression cycle refrigeration systems, and especially those utilizing hot gas by-pass systems for varying the refrigeration capacity of the system.

BACKGROUND OF THE INVENTION

In a simple cycle (i.e. single stage) vapour compression cycle refrigeration system, the refrigerant ideally enters the evaporator as a mixture of saturated liquid and saturated vapour. Full utilization of the heat transfer surfaces in the evaporator circuits requires the presence of liquid refrigerant in or on all parts of the tubes that make up the various circuits of the evaporator. In the evaporator the liquid refrigerant changes, under relatively constant pressures, into a vapour and absorbs heat from the zone serviced by the evaporator. The refrigerant then leaves the evaporator preferably as a saturated vapour, or as a slightly superheated vapour.

The refrigerant next enters the compressor, where it is isentropically compressed to the condensers operating pressure. The refrigerant flows from the compressor and through the condenser under fairly constant pressure conditions, and dissipates heat to the atmosphere.

Finally the refrigerant leaves the condenser as a liquid and flows through the expansion valve and back to the evaporator, with part of the refrigerant flashing into vapour as the line pressure drops across the expansion valve.

Such a simplistic system only operates efficiently and safely within a narrow range of ambient heat loads. Since normal seasonal and even diurnal variations in ambient conditions impose loads outside of the range that can be handled by simplistic systems such as that described hereinabove, steps are usually taken in the design of modern refrigeration equipment so as to provide for a broader range of operating conditions.

These steps typically include the use of thermostatic expansion valves in combination with capillary tubes, flat valves and automatic expansion valves. Even so such equipment is capable of dealing only with those variations in heat load that are imposed by a fairly modest range of ambient operating conditions.

Even with such additions, however, ambient load conditions can still exceed design limitations, and further precautions have been found to be necessary. It is important, for example, that no substantial amount of liquid refrigerant be carried out of the evaporator with the vapour that is returned to the compressor. This problem does arise, however, when the refrigeration equipment is operated at ambient heat loads below the lower limits of the designed heat transfer capacity for that equipment. In such circumstances the amount of ambient heat available at a given flow rate of refrigerant through the evaporator is insufficient to vapourize substantially all of the liquid present in the evaporator. The liquid refrigerant that does exit the evaporator must be trapped before it reaches the compressor, or serious loss of compressor lubrication is likely to result. In-line liquid traps ranging from simple "U" tubes, or swan necks, up to complex suction gas/liquid heat exchanger and suction pots are used for this purpose, with the choice of apparatus depending on the anticipated operating loads.

As has already been mentioned, the full utilization of the heat transfer surfaces in all evaporator circuits requires the presence of liquid refrigerant in or on all parts of the tubes that make up the heat transfer surfaces in the various evaporator circuits. Under very low load conditions, the need to maintain sufficient liquid refrigerant in the evaporator, and the proportionately small amount of heat taken up by that refrigerant relative to the design capacity of the system, may result in too large an amount of liquid refrigerant leaving the evaporator and exceeding the capacity of the above-mentioned traps. The consequences of returning liquid refrigerant to the compressor has also already been mentioned.

Other approaches are therefor used in tandem with those mentioned hereinabove. In small systems the compressor is merely shut down when the cooling thermostat setting has been satisfied. In large systems that option is not as readily available, because of the wear that attends the on/off cycling of the large compressors used in these systems.

Accordingly, in large systems employing centrifugal compressors the capacity may be varied to match a change in ambient loading by: (1) varying the speed at which the compressor is driven; (2) adjusting vanes at the inlet to the impellers; (3) throttling the suction gas; or, (4) varying the condenser pressure. Methods 1 and 2 require feedback controls with their attendant increased capital and maintenance costs. Attempting to control the capacity by either throttling the suction gas or varying the condenser pressure results in reduced system efficiency.

In large systems using the more common reciprocating compressors (and in which the lubrication problems are much more serious than with centrifugal compressors), capacity control can be accomplished through several means which are used in combination with one another. The most common approach is to unload the compressor through a series of unloading stages until a final unloading stage, whereupon a controlled refrigerant bypass of the condenser and the expansion valve is employed to reroute hot-gas to the evaporator, by directing gas from the compressor discharge into the low pressure side of the system, at a point either up or downstream of the evaporator. This approach is known to seriously reduce system efficiency since even though the reduced condenser pressures which normally accompany a reduced system load result in a saving in compressor power, it may interfere with the flow of liquid refrigerant through the expansion device and cause unsatisfactory operation of the system. This is because the expansion valve meters less refrigerant to the evaporator when the system is operated at reduced condenser pressures. In a typical installation equipped with such a hot-gas bypass system, the discharge bypass valve will attempt to compensate for the substantial reduction in suction pressure when the compressor is in its final unloading stage and maintain a given predetermined (i.e. design) pressure. With the reduced demand for refrigerant and less volume of liquid throughput, the expanding liquid has less velocity in the evaporator. It has now been found that this allows the hot gas, that has entered the auxiliary side connector upstream of the evaporator and has been merged into the refrigerant flow leaving the expansion valve and entering the distributor, to push the expanding liquid refrigerant away from some of the distributor tubes. This in turn causes an uneven distribution of vapour and liquid within the various evaporator circuits. The desuperheating that then takes place within the evaporator not only renders some circuits inactive for cooling purposes, but actually results in localized heating of the ambient environment over certain portions of the evaporators heat exchange surface.

One example of the type of installation where these problems are particularly acute is in ship-board airconditioning systems. These "mobile" systems must have a design capacity which will deal with large ranges of sensible heat variation, particularly in the case of ocean-going vessels which often traverse both tropical and high latitudes.

SUMMARY OF THE INVENTION

The present invention relates to a method, an apparatus and a sub-assembly for enhancing the operating range of vapour compression cycle refrigeration systems.

Accordingly, there is provided a method of operating a vapour compression cycle refrigeration system comprising an evaporator, compressor, condenser and expansion valve, and further including compressor unloading means in combination with hot-gas bypass means operable during the final compressor unloading stage for compensating for imbalances between the evaporator's and the compressor's respective cooling capacities under low-load operating conditions, wherein the method comprises the step of metering a flow of hot-gas through said by-pass means while the compressor is still substantially loaded, whereby resulting vapour injection into the distributor increases the refrigerant velocity through the evaporator to thereby assist in returning oil to the compressor.

In addition to improving oil return, this method has the further advantage of helping to ensure more equal distribution of the hot gas to each circuit of a multi-circuited evaporator. Moreover this method also helps to increase the amount of evaporator surface that is active, and thereby aids in air dehumidification even while the system is operating under low-loading conditions. Preferably the hot-gas is metered through the by-pass means in accordance with the above method, while the compressor is still fully loaded.

Additionally, there is provided a method for combining at least two discrete flows of a refrigerant in substantially dissimilar thermodynamic states in a vapour compression cycle refrigeration system, including the step of imparting substantial turbulent mixing of the at least two flows to produce a generally thermodynamically uniform admixture thereof.

In one aspect, the method is intended for use in a gas/liquid refrigerant mixing stage of a vapour compression cycle refrigeration system, and comprises the steps of imparting a substantial helical motion to a first flow of fluid refrigerant in one thermodynamic state, and merging the first flow with a second flow of fluid refrigerant in a dissimilar thermodynamic state. The helical motion of the first flow results in substantial turbulent mixing of the first and second flows upon merging thereof, to produce a generally thermodynamically uniform admixture. In practice these refrigerant flows may be discrete coaxial flows at the point of mixing. Accordingly the present invention includes a method substantially as set forth hereinabove, comprising the steps of imparting a substantial helical motion to the first, axial flow of fluid refrigerant, and merging it with the second, coaxial flow.

Preferably the first, axial flow of fluid refrigerant has a substantial gaseous component, and the second, coaxial flow of fluid refrigerant has a substantial liquid component.

The method of the present invention finds application in the so-called hot-gas condenser by-pass systems mentioned hereinabove. In one such embodiment the first axial flow comprises a hot-gas condenser bypass flow between high and low pressure sides of the vapour compression cycle refrigeration system, which flow is directed through an outer annular channel in a multicircuited evaporator distributor. The second coaxial flow comprises an expanding liquid flow exiting from a thermostatic expansion valve located upstream of the distributor, which second flow is directed through a cylindrical channel located centrally within the outer annular channel of the distributor. In accordance with this embodiment of the invention, the first flow is passed through flow redirecting means arranged within the annular channel. The first flow is thereby imparted with a substantial helical motion, and exits the annular channel and merges with the second flow as the two flows exit their respective channels into the distribution manifold of the distributor. Substantial turbulent mixing of the two flows takes place and results in the formation of a substantially thermodynamically uniform mixture thereof.

Preferably the flow redirecting means imparts a helical motion to the first flow that is substantially normal to the outlets of the distributor.

Also preferably, the helical motion of the first flow comprises a plurality of coaxial helical paths.

The present invention also relates to an apparatus comprising in-line refrigerant flow redirecting means having a plurality of vanes adapted to be disposed in the path of a generally linear refrigerant flow in a vapour compression cycle refrigeration system. The flow redirecting means is preferably a static device, operable in situ to redirect the linear flow into a non-linear flow, whereby downstream thermodynamic uniformity of the flow is increased.

As with the above described method, the apparatus of the present invention has application where two flows of refrigerant are to be commingled. In this aspect of the present invention the flow redirecting means is disposed in the path of a first generally linear flow in a first thermodynamic state, at a location generally upstream of a point at which a second generally linear flow of refrigerant in a second thermodynamic state, is introduced thereto. The flow redirecting means is operable in situ to redirect the first linear flow into a non-linear flow, to thereby produce turbulent admixing of the first and second flows at the point where the two flows are brought together.

Preferably the vanes are arranged so as to impart a substantially helical, (i.e. non-linear) flow to the first flow.

In a preferred embodiment of the present invention the flow redirecting means comprises a disc adapted to be arranged with the plane of said disc normal to the direction of the first flow. A plurality of radially extending slots in the disc define respective surface portions of the disc between adjacent pairs of the slots and an edge of the disc. Each such surface portion has a root end attached to the balance of the disc at an angle adjacent that root end and relative to the plane of the disc so as to provide vanes adapted to impart substantially helical, non-linear flow to the first flow.

In one aspect of the present invention it is contemplated that the disc include resilient root portions, and that the vanes are resiliently biased at said angle, in a first position, and are deflectable into a plurality of other positions on flexion of the root portion caused by the flow of refrigerant past the disc. This has the advantage of maintaining a more constant helical flow velocity, by creating what is in effect a variable venturi between respective leading and trailing edges of adjacent pairs of vanes.

Where the first and second flows are coaxial, the flow redirecting means is preferably adapted to accommodate said second flow through an aperture in the center of said disc. In one embodiment of this aspect of the present invention, the aperture is adapted to receive a tube for conducting the second flow therethrough.

In accordance with yet another aspect of the present invention, there is provided a refrigeration sub-assembly including a multicircuited evaporator distributor adapted to be arranged in a refrigerant flow and flow redirecting means positioned upstream of the distributor. The flow redirecting means is adapted to introduce a non-linear flow of refrigerant into the distributor to improve the uniformity of distribution of refrigerant exiting through the outlet of the distributor. In one embodiment this aspect of the invention includes a side connector for receiving a first flow of hot gas condenser bypass refrigerant and entraining within the first flow a second, coaxial flow of refrigerant from an expansion valve located upstream of the side connector. In this embodiment the flow redirecting means is disposed intermediate the distributor and the side connector, and is operable therebetween to produce a non-linear flow of the hot gas condenser bypass refrigerant around the second coaxial flow.

The flow redirecting means in the sub assembly preferably comprises a plurality of vanes adapted to be disposed in the path of the first flow of said hot gas condenser bypass refrigerant. The vanes are preferably arranged so as to impart a substantially helical, non-linear flow to said first flow. As with the above described apparatus, the flow redirecting means preferably comprises a disc adapted to be arranged with the plane of the disc normal to the direction of flow of the first flow. The disc has a plurality of radially extending slots defining respective surface portions of the disc between adjacent pairs of the slots and an edge of the disc. Each such surface portion has a root end attached to the balance of the disc, and each surface portion is angled adjacent the root end and relative to the plane of the disc so as to provide vanes adapted to impart substantial helical, (i.e. non-linear), motion to the first flow.

As before the disc is preferably adapted to accommodate the second flow through an aperture in the center of the disc. That aperture is, in one embodiment, adapted to receive a side connector tube for conducting the second flow.

In any case, a preferred sub-assembly of the present invention is adapted to produce a helical flow which is substantially normal to the outlets of the distributor, and in particular a helical flow which comprises a plurality of coaxial helical paths is especially preferred. In one embodiment, the helical flow comprises seven such helical paths.

DETAILED DESCRIPTION OF A PREFERRED EMBODIMENT

Introduction to the Drawings

Figure 1:
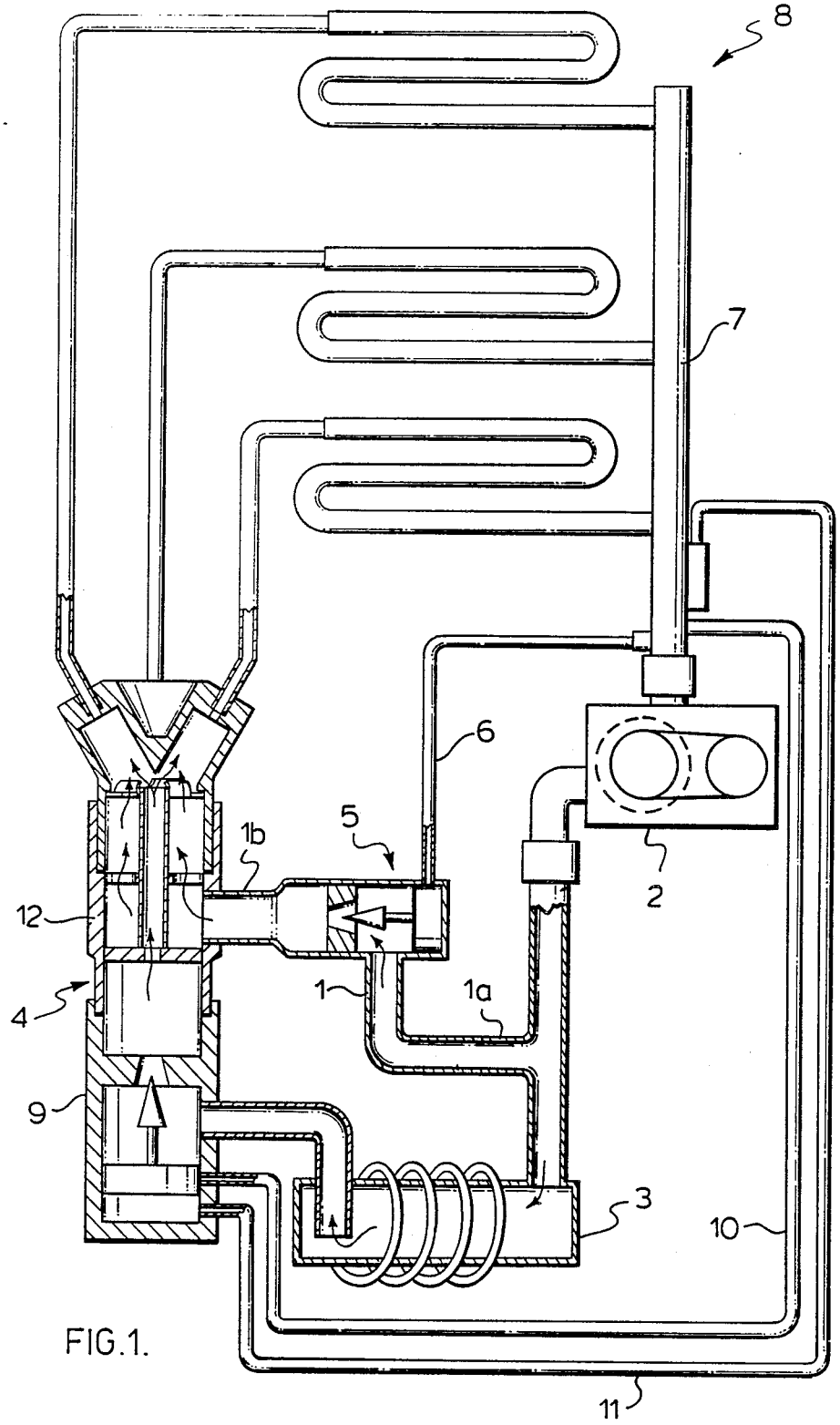

FIG. 1 of the drawings appended hereto is a schematic cross-section through a vapour compression cycle refrigeration system.

FIG. 2 of the drawings is an exploded perspective view of a subassembly including means for imparting helical motion to a first axial flow in a hot-gas bypass system.

FIG. 3 shows an alternative embodiment of the helical motion imparting means depicted in FIG. 2.

Referring now to FIG. 1 of the drawings, there is shown in partial cross-section, a schematic representation of a vapour compression refrigeration system which is equipped with a hot-gas bypass line, 1, connected at one end thereof, 1*a*, to the high pressure side of the system, between the compressor 2, and the condenser 3. In keeping with known practice, the connection of end 1*a* to the high pressure side of the system is preferably as close to the compressor as possible. The hot-gas bypass line is connected at its other end, 1*b*, to the low pressure side of the system, through a side connector to a thermostatic expansion valve/distributor sub-assembly, 4. A metering valve 5, including an external pressure equalizing line 6 arranged between valve 5 and the vapour collection manifold 7 of evaporator 8, is connected intermediate the two ends, 1*a* and 1*b*, of bypass line 1, preferably as close to end 1*a* as possible, in keeping with known practice in the art. Valve 5 is operable, to control the flow of hot-gas that bypasses condenser 3 in response to pressure drops across the system.

Subassembly 4 includes a thermostatic expansion valve 9 and a side connector/distributor subassembly 12. Expansion valve 9 is connected downstream of the condenser 3 and is adapted to receive and meter refrigerant flowing from condenser 3 to evaporator 8. Subassembly 4 is connected in known manner to the vapour collection manifold 7, through an equalizer line 10 and through a temperature sensing element/bulb subassembly 11.

Referring now to FIG. 2 of the drawings, there is shown an exploded, partially cut-away perspective view of side connector/distributor sub-assembly 12, which is shown in cross-section in FIG. 1, and which is connected to receive hot-gas metered through valve 5. In operation, the hot-gas flow, indicated by arrow A in FIG. 2, exits tube end 1*b*, and enters an annular chamber 13 whose only exits are perforations 14 formed in the septum plate 15 that is located at one end of chamber 13, downstream of tube 1*b*. The hot-gas leaves the chamber 13 through the perforations 14 and enters an outer annular channel 16. Disc 17 is adapted to be arranged with the plane of the disc normal to the direction of the axial flow of the hot-gas within the outer annular channel 16. A plurality of radially extending slots 21 in the disc 17 define respective surface portions of the disc between adjacent pairs of the slots and an edge 22 of the disc. Each slot 21 is generally "L" shaped, having a first, radially extending portion and a second portion extending substantially normal to the first and generally parallel to the outer edge 23 of the disc. Each such surface portion has a root end attached to the balance of the disc. The surface portions are angled adjacent their respective root ends and relative to the plane of the disc so as to form vanes 18 adapted to impart a substantially helical flow pattern to the first flow. Disc 18 is located within passage 16 in in-line refrigerant flow-directing relation in the path of the generally linear hot-gas refrigerant flow exiting from the septum plate 15. The disc redirects the linear flow of hot-gas refrigerant into a helical (i.e. non-linear) flow pattern. The disc is formed to receive tube 19 through a hole in the center of the disc.

The flow of saturated liquid/vapour refrigerant, indicated by Arrow B, exits the thermostatic expansion valve 9, enters tube 19 at the base thereof, and travels coaxially relative to the flow of hot-gas in outer annular channel 16, upwardly into the interior of the distributor body 20. In the distributor body 20 the generally linear flow "B" mixes with the helical flow of the hot-gas as the two flows exit tube 19 and chamber 16, respectively. The mixing of the two flows in their respective, different thermodynamic states, due to the helical flow pattern imparted to the first flow of hot-gas by disc 17, improves the uniformity of the admixture. This in turn helps to reduce the risk of localization of unevaporated refrigerant within the various evaporator circuits and the various problems that ensue under such undesirable conditions. Moreover, the latent heat of the hot-gas is well distributed and this helps to avoid liquid refrigerant being returned to the compressor.

FIG. 3 of the drawings illustrates an alternative embodiment of the disc 17 shown in FIG. 2. Disc 24 in FIG. 3 comprises a disc in which adjacent pairs of slots extend radially inwardly from the outer edge 26 of the disc 24, and define between them, surface portions each having a root end attached to the balance of the disc. These surface portions are angled adjacent their respective root ends and relative to the plane of the disc so as to form vanes 27 adapted to impart a substantially helical flow pattern to the first flow. In this embodiment a portion of the outer edge of each surface portion, indicated at reference numeral 28, is removed to increase the size of the passage formed between respective leading and trailing edges of adjacent vanes 27. In accordance with one contemplated arrangement of the present invention the discs 17 and 24 are used in a tandem mutually spaced-apart arrangement within the channel 16, preferably with disc 17 positioned upstream in the refrigerant flow, relative to disc 24.

I claim:

1. A method for use in a gas/liquid mixing stage of a vapour compression cycle refrigeration system, comprising the steps of imparting a substantial helical motion to a first flow of fluid refrigerant in one thermodynamic state, and merging said first flow with a second flow of fluid refrigerant in another dissimilar thermodynamic state, whereby the helical motion of the first flow results in substantial turbulent mixing of the first and second flows upon merging thereof, to produce a generally thermodynamically uniform admixture.

2. The method of claim 1 comprising the steps of imparting a substantial helical motion to a first, axial flow of fluid refrigerant in one thermodynamic state, and merging said first flow with a second, coaxial flow of fluid refrigerant in another dissimilar thermodynamic state.

3. The method of claim 2 wherein the first, axial flow of fluid refrigerant has a substantial gaseous component, and the second, coaxial flow of fluid refrigerant has a substantial liquid component.

4. The method of claim 3 wherein the first, axial flow comprises a hot gas, condenser bypass flow between high and low pressure sides of the vapour compression cycle refrigeration system, which flow is directed through an outer annular channel to a multicircuited evaporator distributor, and the second, coaxial flow comprises an expanding liquid flow exiting a thermostatic expansion valve located upstream of the distributor, which second flow is directed through a cylindrical tube located centrally within the outer annular channel of the distributor, and wherein the first flow passes through helical-flow-imparting flow redirecting means arranged within the annular channel and is thereby imparted with a substantial helical motion, and the first flow exits the annular channel and merges with the second flow as the first and second flows exit their respective channels into a distribution manifold of the distributor, where substantial turbulent mixing of the two flows takes place and results in a substantially thermodynamically uniform mixture thereof.

5. The method of claim 4 wherein the flow redirecting means imparts a helical motion substantially normal to the outlets of the distributor.

6. The method of claim 4 wherein the helical motion comprises a plurality of coaxial helical paths.

7. The method of claim 4 wherein the helical motion comprises seven helical paths.

8. An apparatus comprising in-line refrigerant flow directing means having a plurality of vanes adapted to be disposed in the path of a generally linear refrigerant flow in a refrigeration system, and operable in situ to re-direct said linear flow into a non-linear flow whereby the thermo-dynamic uniformity of the flow is increased;

said means being disposed in the path of a first generally linear flow in a first thermo-dynamic state, at a location generally upstream of a point at which a second generally linear flow of refrigerant in a second thermal dynamic state, is introduced thereto, said means being operable and situ to redirect said first linear flow into a non-linear flow to thereby produce turbulent admixing of said first and second flows at said point;

said vanes being arranged to impart a substantially helical, non-linear flow to said first flow;

said means comprising a disc adapted to be arranged with the plane of said disc normal to the direction of flow of said first flow and having a plurality of radially extending slots in said disc defining respective vane surface portions of said disc between adjacent pairs of said slots and an edge of said disc, each such surface portion having a root end attached to the balance of said disc, at an angle adjacent said root end and relative to said plane of said disc so as to be adapted to impart said substantially helical common non-linear flow to said first flow.

9. A refrigeration subassembly including a distributor adapted to be arranged in a refrigerant flow and means positioned upstream of said distributor and being adapted to introduce a non-linear flow of refrigerant into said distributor to improve uniformity of distribution of refrigerant exiting through the outlet of said distributor and further including: a side connector for receiving a first flow of hot gas condenser bypass refrigerant and entraining within said first flow a second, co-axial flow of refrigerant from an expansion valve; and wherein said means is disposed intermediate said distributor and said side connector, and is operable therebetween to produce a non-linear flow of said hot gas condenser bypass refrigerant around said second co-axial flow.

10. A method of operating a vapour compression cycle refrigeration system comprising an evaporator, compressor, condenser, and expansion valve, and further including compressor unloading means including hot gas bypass means operable as a final compressor unloading step for compensating for imbalances between the evaporators and compressors respective cooling capacities under low load operating conditions, wherein the method comprises a step of metering a flow of hot gas through said bypass means while the compressor is still substantially loaded, whereby resulting vapour injection into the distributor increases the refrigerant velocity through the evaporator to thereby assist in returning oil to the compressor; and further including the step of imparting substantial turbulent mixing of the hot gas bypass flow with the flow of refrigerant from the condenser at a point downstream of the condenser to produce a generally thermo-dynamically uniform add mixture thereof, wherein a substantial helical motion is imparted to the bypass flow of hot gas, which is then merged with the glow of refrigerant exiting the expansion valve, whereby the helical motion of the hot gas flow results in substantial turbulent mixing of the hot gas and expanding refrigerant flows upon merging thereof, to produce a generally thermo-dynamically uniform admixture.

11. The sub-assembly according to claim 9 wherein means comprises a plurality of vanes adapted to be disposed in the path of said first flow of said hot gas condenser bypass refrigerant.

12. The sub-assembly according to claim 11 wherein said vanes are arranged so as to impart a substantially helical, non-linear flow to said first flow.

13. The sub-assembly according to claim 12 wherein said means comprises a disc adapted to be arranged with the plane of said disc normal to the direction of flow of said first flow and having a plurality of radially extending slots in said disc defining respective surface portions of said disc between adjacent pairs of said slots and an edge of said disc, each such surface portion having a root end attached to the balance of said disc, and being angled adjacent said root end and relative to said plane of said disc so as to be adapted to impart substantially helical, non-linear flow to said first flow.

14. The sub-assembly according to claim 13 wherein said disc is adapted to accommodate said second flow through an aperture in the center of said disc.

15. The sub-assembly according to claim 14 wherein said aperture is adapted to receive a side connector tube for conducting the second flow.

16. The sub-assembly of claim 15 wherein said helical flow is substantially normal to the outlets of the distributor.

17. The sub-assembly of claim 16 wherein the helical flow comprises a plurality of coaxial helical paths.

18. The sub-assembly of claim 17 wherein the helical flow comprises seven helical paths.

19. The method of claim 10 comprising the steps of imparting a substantial helical motion to a first, axial bypass flow of hot gas, and merging said hot gas flow with a second, co-axial flow of expanding refrigerant exiting the expansion valve.

20. The method of claim 19 wherein the axial flow of hot-gas has a substantial gaseous component, and the coaxial flow of refrigerant has a substantial liquid component.

21. The method of claim 20 wherein the flow redirecting means imparts a helical motion substantially normal to the outlets of the distributor.

22. The method of claim 20 wherein the helical motion comprises a plurality of coaxial helical paths.

23. The method of claim 20 wherein the helical motion comprises seven helical paths.

24. The apparatus according to claim 8 including resilient portions and wherein the vanes are resiliently biased at said angle in a first position, and are deflectable into a plurality of other positions on flexion of the root portion caused by the flow of refrigerant past the disc.

25. The apparatus according to claim 8 wherein the disc is adapted to accommodate said second flow through an aperture in the center of said disc.

26. The apparatus according to claim 25 wherein said aperture is adapted to receive a tube for conducting the second flow therethrough.

27. A method of operating a vapour compression cycle refrigeration system comprising: an evaporator, compressor, condenser, and expansion valve, and further including compressor unloading means, including hot gas bypass means operable as a final compressor unloading step for compensating for imbalances between the evaporators and the compressors respective cooling capacities under low load operating conditions, wherein the method comprises a step of metering a flow of hot gas through said bypass means while the compressor is still substantially loaded, whereby resulting vapour injection into the distributor increases the refrigerant velocity through the evaporator to thereby assist in returning oil to the compressor; wherein a first, axial hot gas condenser bypass flow between high and low pressure sides of the vapour compression cycle refrigeration system, is directed through an outer annular channel to a multi-circuited evaporator distributor, and a second co-axial flow comprises an expanding liquid flow exiting a thermostatic expansion valve located upstream of the distributor, which second flow is directed through a cylindrical tube located centrally within the outer annular channel of the distributor, and wherein the first flow passes through helical flow imparting flow redirecting means positioned within the annular channel and is thereby imparted with a substantial helical motion, and the first axial flow exits the annular channel and merges with the second flow as the first and second flows exit their respective channels into a distributor manifold of the distributor, where substantial turbulent mixing of the two flows takes place and results in a substantially thermodynamically uniform mixture thereof.

28. An apparatus comprising in-line refrigerant flow-directing means having a plurality of vanes adapted to be disposed in the path of a generally linear refrigerant flow in a refrigeration system, and operable in situ to redirect said linear flow into a non-linear flow whereby the thermodynamic uniformity of the flow is increased; wherein said means is disposed in the path of a first generally linear flow in a first thermodynamic state, at a location generally upstream of a point at which a second generally linear flow of refrigerant in a second thermodynamic state, is introduced thereto, said means being operable in situ to redirect said first linear flow into a non-linear flow to thereby produce turbulent admixing of said first and second flows at said point; and, wherein said vanes are arranged so as to impart a substantially helical, non-linear flow to said first flow.

* * * * *